US009777584B2

(12) United States Patent
Cadieux

(10) Patent No.: US 9,777,584 B2
(45) Date of Patent: Oct. 3, 2017

(54) OUTBOARD INSERTION SYSTEM OF VARIABLE GUIDE VANES OR STATIONARY VANES

(71) Applicant: Rolls-Royce plc, London (GB)

(72) Inventor: Michel Cadieux, Notre-Dame-de-I'Île-Perrot (CA)

(73) Assignee: ROLLS-ROYCE PLC, London (GB)

( * ) Notice: Subject to any disclaimer, the term of this patent is extended or adjusted under 35 U.S.C. 154(b) by 770 days.

(21) Appl. No.: 14/144,334

(22) Filed: Dec. 30, 2013

(65) Prior Publication Data

US 2014/0255177 A1 Sep. 11, 2014

Related U.S. Application Data

(60) Provisional application No. 61/774,454, filed on Mar. 7, 2013.

(51) Int. Cl.

| | |
|---|---|
| ***F01D 9/02*** | (2006.01) |
| ***F01D 9/04*** | (2006.01) |
| *F01D 5/18* | (2006.01) |
| *F01D 17/16* | (2006.01) |
| *F01D 25/00* | (2006.01) |

(52) U.S. Cl.

CPC ..... *F01D 9/02* (2013.01); *F01D 9/042* (2013.01); *F01D 5/187* (2013.01); *F01D 17/162* (2013.01); *F01D 25/002* (2013.01); *F05D 2220/321* (2013.01); *F05D 2220/3216* (2013.01); *F05D 2230/60* (2013.01); *F05D 2240/12* (2013.01); *Y10T 29/49229* (2015.01)

(58) Field of Classification Search

CPC ... F01D 9/02; F01D 9/04; F01D 9/042; F01D 17/162; F01D 5/187; F05D 2270/321; F05D 2270/3216; F05D 2230/60; F05D 2240/12; F05D 2240/128; F05D 2240/14; Y10T 29/49229; Y10T 29/49321; Y10T 29/49323

See application file for complete search history.

(56) References Cited

U.S. PATENT DOCUMENTS

| | | | | |
|---|---|---|---|---|
| 2,755,064 A * | 7/1956 | Simonsen | ..... | F01D 9/042 415/209.3 |
| 2,834,537 A * | 5/1958 | Neary | ..... | F01D 9/042 415/209.2 |
| 2,924,425 A * | 2/1960 | Cutler | ..... | B23P 15/006 415/209.4 |

(Continued)

FOREIGN PATENT DOCUMENTS

| | | |
|---|---|---|
| EP | 0747574 | 11/1996 |
| GB | 599391 | 11/1948 |

OTHER PUBLICATIONS

International Search Report PCT/US2013/078386 dated Jun. 4, 2014.

*Primary Examiner* — Craig Kim
*Assistant Examiner* — Wayne A Lambert
(74) *Attorney, Agent, or Firm* — Oliff PLC

(57) ABSTRACT

A method of assembling a gas turbine engine comprising the steps of providing a casing having an insertion aperture in its outer surface. A guide vane is inserted through the insertion aperture. The guide vane is secured to the outer surface of the casing such that the guide vane can be serviced from an outer part of the casing.

18 Claims, 5 Drawing Sheets

(56) References Cited

U.S. PATENT DOCUMENTS 3,836,282 A * 9/1974 Mandelbaum ..... F01D 9/042 415/209.4
4,082,477 A 4/1978 Kronogard
4,378,961 A * 4/1983 Trousdell ..... F01D 9/042 415/137
4,498,790 A * 2/1985 Fisher ..... F01D 17/162 384/296
4,585,395 A * 4/1986 Nourse ..... F01D 5/141 415/181
4,594,761 A * 6/1986 Murphy ..... B23P 15/04 29/418
4,643,636 A 2/1987 Libertini
4,820,120 A * 4/1989 Feuvrier ..... F01D 9/042 415/189
4,832,568 A * 5/1989 Roth ..... F01D 9/042 415/189
4,940,386 A * 7/1990 Feuvrier ..... F01D 9/04 415/189
4,953,282 A 9/1990 Corsmeier et al.
5,039,277 A * 8/1991 Naudet ..... F04D 29/563 415/150
5,074,752 A * 12/1991 Murphy ..... F01D 9/042 415/119
5,083,900 A * 1/1992 Carletti ..... F01D 9/042 415/191
5,328,327 A * 7/1994 Naudet ..... F01D 17/162 29/889.22
5,474,419 A * 12/1995 Reluzco ..... F01D 9/044 415/209.4
5,494,404 A * 2/1996 Furseth ..... F01D 9/042 415/209.3
5,630,700 A * 5/1997 Olsen ..... F01D 5/189 415/134
6,299,412 B1 * 10/2001 Wood ..... F01D 5/141 416/223 A
6,312,219 B1 * 11/2001 Wood ..... F01D 5/005 415/191
6,409,472 B1 * 6/2002 McMahon ..... F01D 5/3023 415/119
6,450,766 B1 * 9/2002 Honda ..... F01D 9/042 415/191
6,464,456 B2 * 10/2002 Darolia ..... F01D 9/042 415/134
6,619,917 B2 * 9/2003 Glover ..... F01D 9/042 29/889.22
6,640,437 B2 11/2003 McFarland
6,843,638 B2 1/2005 Hidalgo et al.
7,025,563 B2 4/2006 Servadio et al.
7,125,222 B2 * 10/2006 Cormier ..... F01D 17/162 384/295
7,147,434 B2 * 12/2006 Mons ..... F01D 9/042 29/458
7,278,819 B2 10/2007 Schilling
7,311,495 B2 * 12/2007 Ashley ..... F01D 5/26 415/209.4
7,360,990 B2 4/2008 Barbe et al.
7,413,400 B2 * 8/2008 Barnett ..... F01D 9/042 415/119
7,527,471 B2 5/2009 Schilling
7,648,336 B2 1/2010 Cairo
7,665,963 B2 * 2/2010 Bogue ..... F01D 5/005 29/888.02
7,722,318 B2 * 5/2010 Addis ..... B23P 6/005 415/148
7,722,321 B2 5/2010 Lhoest et al.
7,959,408 B2 6/2011 Belmonte
8,267,646 B2 9/2012 Robertson
8,371,812 B2 2/2013 Manteiga et al.
8,966,756 B2 * 3/2015 Feigleson ..... F01D 9/042 29/458
2007/0241257 A1 * 10/2007 Eleftheriou ..... F01D 25/162 248/554
2011/0033285 A1 * 2/2011 Turi ..... F01D 9/044 415/182.1
2011/0171018 A1 7/2011 Garcia-Crespo
2012/0076658 A1 3/2012 Jarrett, Jr. et al.

* cited by examiner

OUTBOARD INSERTION SYSTEM OF VARIABLE GUIDE VANES OR STATIONARY VANES

CROSS-REFERENCE TO RELATED APPLICATIONS

This application claims priority to U.S. Provisional Patent Application No. 61/774,454, filed Mar. 7, 2013, the contents of which are hereby incorporated in their entirety.

FIELD OF TECHNOLOGY

A gas turbine engine includes compressors and turbines, and more particularly, improved variable or stationary guide vanes that employ an outboard insertion method and construction.

BACKGROUND

Gas turbine variable and fixed vanes are traditionally assembled and accessed from the gas path that is in part defined by the fan casing. Getting access inside the fan casing is difficult and makes servicing the variable or stationary guide vanes very difficult, costly, and time consuming. It would be desirable to improve the serviceability of guide vanes.

Providing a system of inserting the guide vane in a manner that is outboard of the fan case or gas path would be helpful. Such a system would save the manufacturing involvedness related to the conventional gas path internal assembly method, specifically for the compressor section. It would be desirable to employ an improved variable guide vane assembly that improves compressor and turbine performances and offers various functional derivatives. It also would be desirable to provide an improved vane guide system that uses basic manufacturing methods and can be well adapted for very thick aerospace casings.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description. Exemplary illustrations are described in detail by referring to the drawings as follows:

DETAILED DESCRIPTION

This application serves for the heavy frame, industrial and aero gas turbine engines, specifically for the compressor and turbine sections. The current practice is to insert the variable vanes and or stationary vanes by the internal flow path requiring multiple assembling steps.

Figure 1:
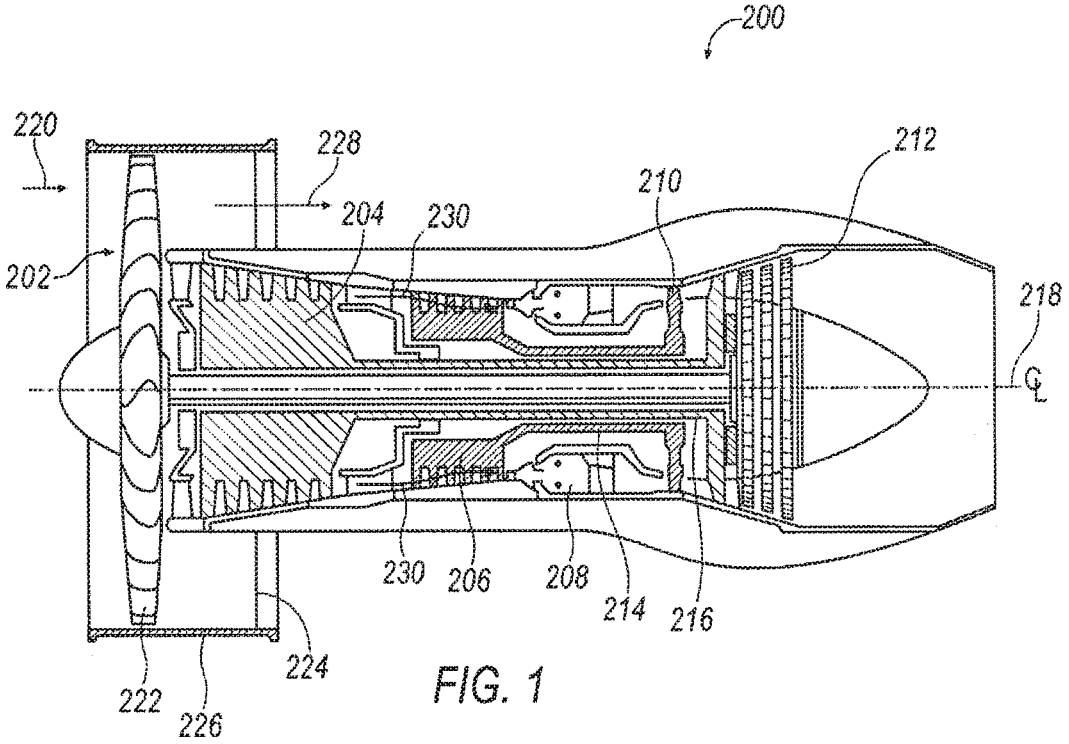
FIG. 1 illustrates an exemplary cross-section of a gas turbine engine assembly.

FIG. 1 illustrates a gas turbine engine 200 in an aero configuration, which includes a fan 202, a low pressure compressor and a high pressure compressor, 204 and 206, a combustor 208, and a high pressure turbine and low pressure turbine, 210 and 212, respectively. The high pressure compressor 206 is connected to a first rotor shaft 214 while the low pressure compressor 204 is connected to a second rotor shaft 216. The shafts extend axially and are parallel to a longitudinal center line axis 218. Ambient air 220 enters the fan 202 and is directed across a fan rotor 222 in an annular duct 224, which in part is circumscribed by fan case 226. Bypass airflow 228 provides engine thrust while a primary gas stream 230 is directed to a combustor 208 and the high pressure turbine 210.

Figure 2:
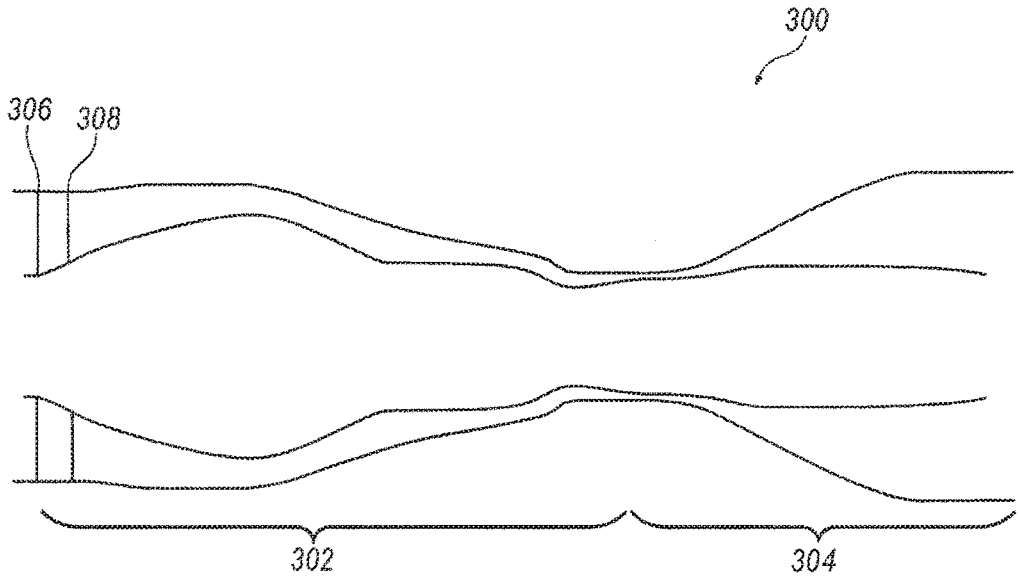
FIG. 2 illustrates an exemplary cross-section of a heavy frame gas turbine engine.

FIG. 2 illustrates a cross-section of a portion of a gas turbine engine 300 in a heavy frame configuration. The gas turbine engine 300 comprises a compressor portion 302 and a turbine portion 304. The illustrated configuration includes an air inlet casing 306 and a guide casing 308 through which air is directed into the gas turbine engine 300. It should be understood that the illustrated embodiments are merely exemplary and a number of modifications and alterations would be obvious to one skilled in the art in light of the present disclosure. Although the present disclosure refers to new and novel features of the guide casing 308, it is contemplated that the location of the guide casing 308 may be introduced between the first stages and any subsequent stages of the compressor 302 or turbine 304 sections.

Figure 3:
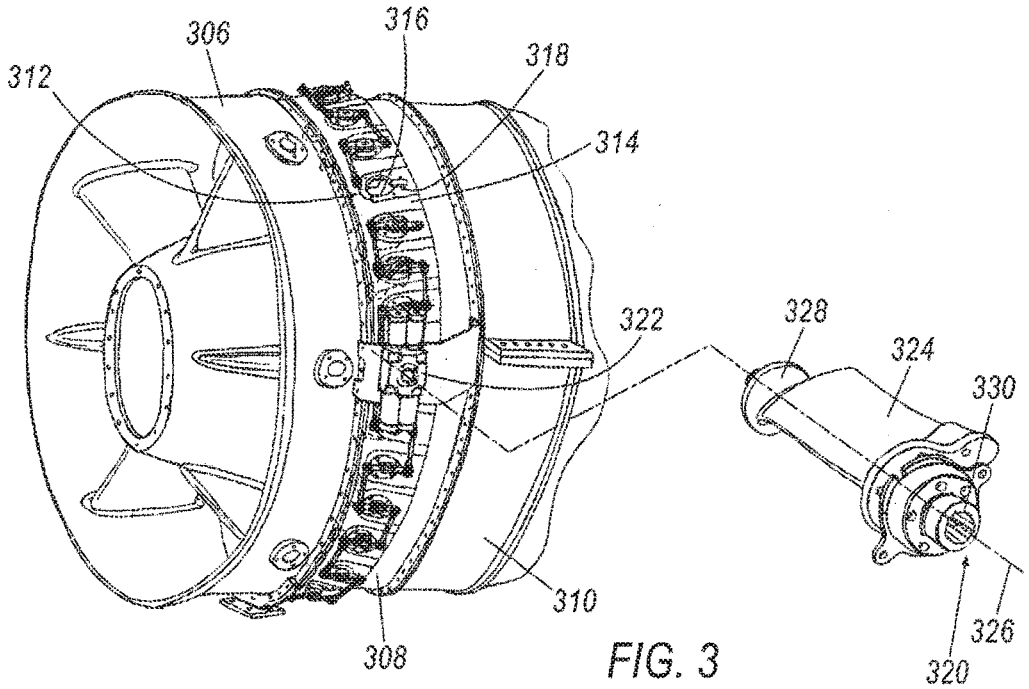
FIG. 3 illustrates an exploded perspective view of a guide vane assembly and its insertion locations relative to the engine.
Figure 4:
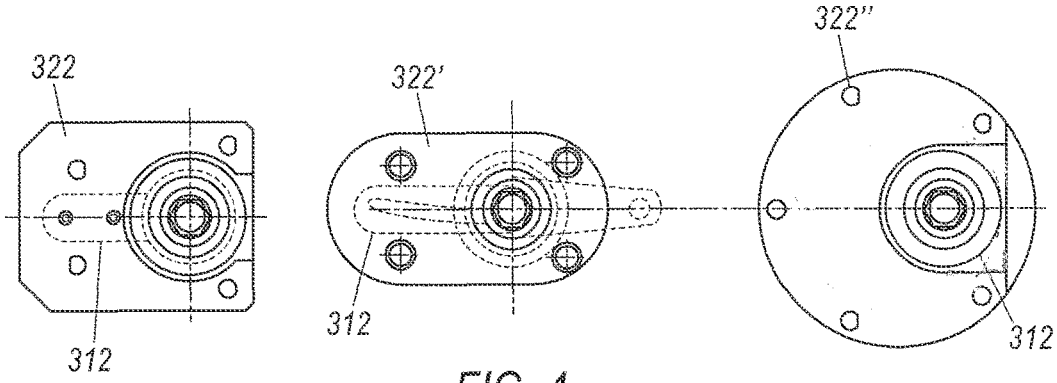
FIG. 4 illustrates a variety of embodiments of guide vane housings.

FIG. 3 is a detailed portion of the gas turbine engine 300 illustrated in FIG. 2. The illustration shows the guide casing 308 positioned between the air intake casing 306 and an aft structural casing 310. The guide casing 308 includes a plurality of insertion apertures 312 formed along its perimeter on an outer surface 314. Although a variety of shapes and sizes of the insertion apertures 312 are contemplated, one embodiment contemplates the use of a main insertion portion 316 and a vane slot 318. It is contemplated that the insertion apertures 312 are configured so as not to limit the vane chord length and camber or the spacing of vanes about the guide casing 308. A plurality of guide vanes 320 are configured to be inserted into the guide casing 308 from the exterior of the gas turbine engine 300. This design arrangement eliminates the usual gas path guide vane insertion methodology. An attachment feature 322, such as a guide vane housing, is utilized to secure each of the guide vanes 320 to the exterior of the guide casing 308. The guide vane housing 322 is preferably configured to seal the insertion aperture 312 to prevent pressurized air from escaping from within the guide casing 308. A variety of configurations for guide vane housings 322 are detailed in FIG. 4. It is further contemplated that the guide vanes 320 may comprise either static mount guide vanes or variable position guide vanes. Where variable position guide vanes are desired, the guide vanes 320 preferably include a vane portion 324, a rotatable vane centerline 326, a lower vane mount 328 and an upper vane mount 330.

Figure 5:
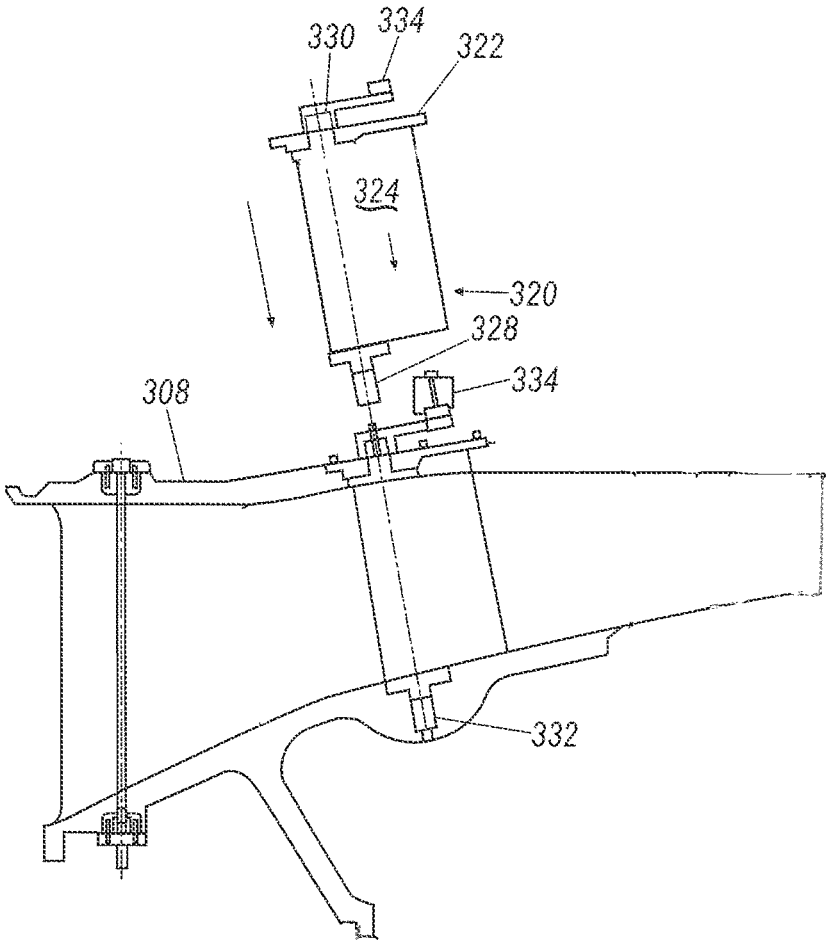
FIG. 5 illustrates an enlarged side sectional view of the outboard guide vane insertion system showing a guide vane inserted into an inner gas path of the single shroud inner case.

FIG. 5 illustrates a cross-sectional detail of a guide vane 320 inserted into the guide casing 308. The guide vane 320 is inserted from the exterior of the guide casing 308, downward until it engages a floating mount 332 formed on an interior surface of the guide casing 308. The guide vane housing 322 is then utilized to seal and secure the guide vane 320 to the guide casing 308. It is contemplated that the guide vane housing 322 accomplishes this sealing and securing function while still allowing the interaction of outside control mechanisms 334 positioned exterior of the guide casing 308. The present disclosure contemplates a wide variety of control mechanisms including gearing, levers, or even a unison ring to control the position of variable position guide vanes. These mechanisms would be known to one skilled in the art in light of the present disclosure. The nature of the disclosed exterior guide vane 320 insertion improves system facilitates the repairability by an ease of replacement without disassembling or splitting the gas turbine engine modules. The disclosed system allows the completion of the module assemblies even if there are vanes shortages. Such improved system contributes to savings complex manufacturing matched set procedures of the typical inner path central vane retaining rings.

Figure 6:
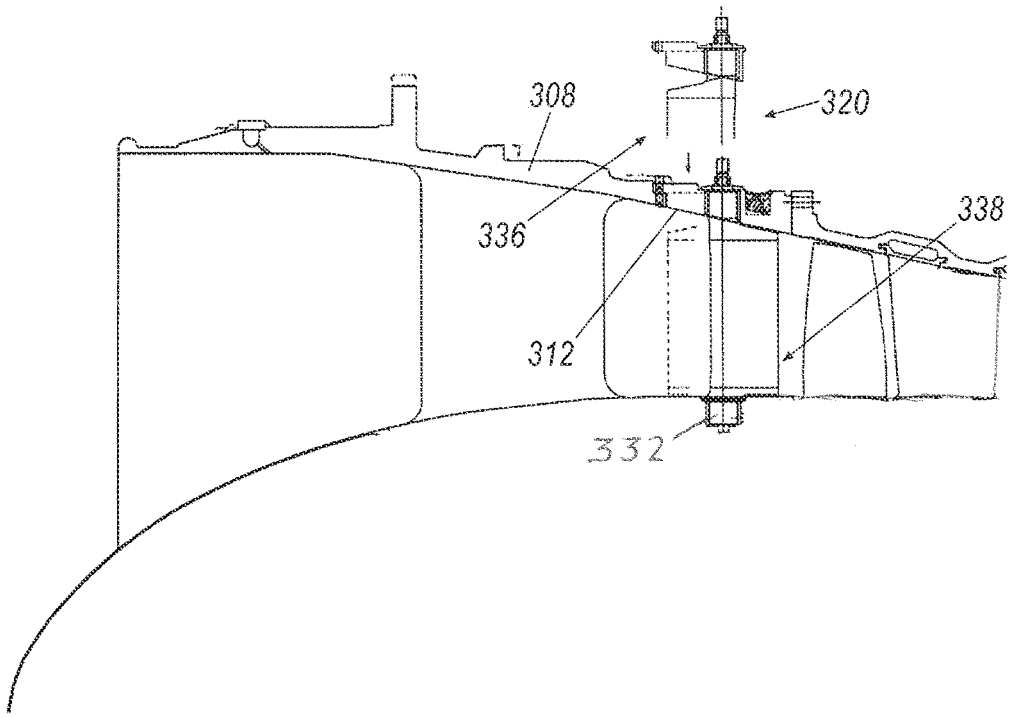
FIG. 6 illustrates an alternate enlarged side sectional view of the outboard guide vane insertion system showing a guide vane inserted into an inner gas path of the single shroud inner case.

FIG. 6 illustrates an alternate embodiment wherein the insertion aperture 312 is configured such that the guide vane 320 is inserted into the guide casing 308 in an insertion orientation 336. The guide vane 320 is then rotated into an operational orientation 338 prior to securing to the exterior of the guide casing 308. (The guide vane 320 is rotated greater than 90 degrees between the insertion orientation 336 and the operational orientation 338.) This allows installation of guide vanes 320 into tight locations and allows for a closer spacing of guide vanes 320. In addition, the present configuration may allow for a more secure retention of the guide vane 320 within the guide casing 308.

Figure 7:
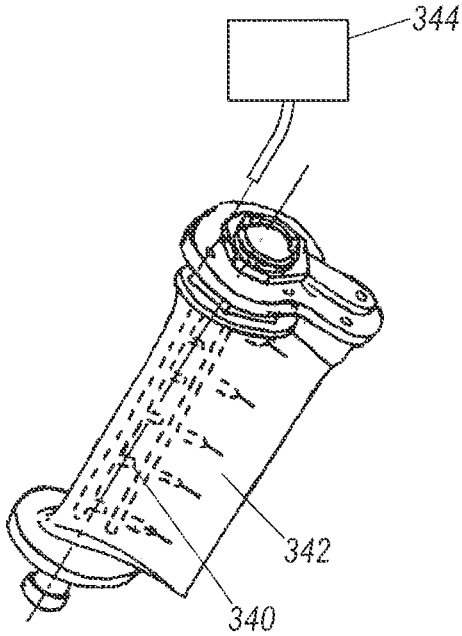
FIG. 7 illustrates an alternate guide vane incorporating cooling or compressor wash features.

FIG. 7 illustrates an embodiment of a guide vane 320 for use in the present disclosure. The present disclosure contemplates that each of the guide vanes 320 may include a plurality of cooling channels 340 and/or pressure wash nozzles 342 incorporated therein. This allows the guide vane 320 after installation in the guide casing 308 to be placed in communication with a remote fluid source 344. The remote fluid source 344 may comprise an external cooling system such that thermal control of the guide vanes 320 is achieved. Alternately the remote fluid source 344 may comprise a pressurized fluid source such that pressurized fluid may be dispensed by the pressure wash nozzles 342 in order to introduce a wash into the engine.

The present disclosure is an asset for manufacturing to align and perform drillings of the fan casing outer and inner bores within a unique set up resulting to great axial accuracy. It allows the combination of incorporating optional intercooling or compressor soak wash systems and the related feed manifolds and pipes. It enables performance upgrades for existing engine fleets or during engine development tests with diverse airfoil profiles. The improved system may enhance engine operating conditions.

It will be appreciated that the aforementioned method and devices may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed is:

1. A method of assembling a gas turbine engine comprising the steps of:

providing a casing, said casing having an insertion aperture in its outer surface;

providing a guide vane;

inserting said guide vane through said insertion aperture in said casing while said guide vane is in an insertion orientation;

rotating said guide vane from said insertion orientation to an operational orientation about a longitudinal axis of the guide vane after full insertion; and securing said guide vane to the outer surface of said casing, wherein said guide vane can be serviced from an outer part of said casing.

2. The method of assembling a gas turbine engine as claimed in claim 1, further comprising:

installing a guide vane housing to secure said guide vane to the outer surface, said guide vane housing configured to seal said insertion aperture.

3. The method of assembling a gas turbine engine as claimed in claim 1, wherein said guide vane comprises a static mount guide vane.

4. The method of assembling a gas turbine engine as claimed in claim 1, wherein said guide vane comprises a variable position guide vane.

5. The method of assembling a gas turbine engine as claimed in claim 1, further comprising:

placing an external cooling system in fluid communication with said guide vane after insertion, said guide vane including a plurality of cooling channels formed therein.

6. The method of assembling a gas turbine engine as claimed in claim 1, further comprising:

placing a pressurized fluid reservoir in fluid communication with said guide vane after insertion, said guide vane including a plurality of compressor wash nozzles formed therein.

7. A gas turbine engine comprising:

a guide casing having an insertion aperture in its outer surface, the guide casing being positioned axially between and connected to a fore casing and an aft casing;

a guide vane configured to be inserted into said guide casing through said insertion aperture from outside said guide casing; and a housing for securing said guide vane partially within said insertion aperture on the outer perimeter of said guide casing, said guide vane having a portion that is mounted in the air flow path of the gas turbine engine, wherein said insertion aperture is configured such that said guide vane is inserted through said insertion aperture while said guide vane is in an insertion orientation and rotated from said insertion orientation to an operational orientation about a longitudinal axis of the guide vane after full insertion.

8. The gas turbine engine as claimed in claim 7, wherein said guide vane is rotated greater than 90 degrees between said insertion orientation and said operational orientation.

9. The gas turbine engine as claimed in claim 7, wherein said guide vane comprises a static mount guide vane.

10. The gas turbine engine as claimed in claim 7, wherein said guide vane comprises a variable position guide vane.

11. The gas turbine engine as claimed in claim 7, wherein said housing secures said guide vane to the outer surface, and said housing is configured to seal said insertion aperture to said outer surface.

12. The gas turbine engine as claimed in claim 7, further comprising:

an external cooling system in fluid communication with said guide vane, said guide vane including a plurality of cooling channels formed therein.

13. The gas turbine engine as claimed in claim 7, further comprising:

a pressurized fluid reservoir in fluid communication with said guide vane, said guide vane including a plurality of compressor wash nozzles formed therein.

14. A gas turbine engine comprising:

a guide casing having an insertion aperture in its outer surface, the guide casing being positioned axially between and connected to a fore casing and an aft casing;

a guide vane configured to be inserted into said guide casing through said insertion aperture from outside said guide casing; and a guide vane housing for securing said guide vane partially within said insertion aperture on the outer perimeter of said guide casing, said guide vane housing sealing said insertion aperture, wherein said insertion aperture is configured such that said guide vane is inserted through said insertion aperture while said guide vane is in an insertion orientation and rotated from said insertion orientation to an operational orientation about a longitudinal axis of the guide vane after full insertion.

15. The gas turbine engine as claimed in claim 14, wherein said guide vane is rotated greater than 90 degrees between said insertion orientation and said operational orientation.

16. The gas turbine engine as claimed in claim 14, further comprising:

a floating mount formed within an interior surface of said guide casing, said floating mount configured to engage one end of said guide vane.

17. The gas turbine engine as claimed in claim 14, further comprising:

an external cooling system in fluid communication with said guide vane, said guide vane including a plurality of cooling channels formed therein.

18. The gas turbine engine as claimed in claim 14, further comprising:

a pressurized fluid reservoir in fluid communication with said guide vane, said guide vane including a plurality of compressor wash nozzles formed therein.

* * * * *